US007651375B2

(12) United States Patent
Zhu et al.

(10) Patent No.: US 7,651,375 B2
(45) Date of Patent: Jan. 26, 2010

(54) CABLE ASSEMBLY HAVING OUTER COVER ROBUSTLY SUPPORTED

(75) Inventors: Jiang-Hua Zhu, Kunshan (CN); David Tso-Chin Ko, Fullerton, CA (US); Hai-Wei Wang, Kunshan (CN); Xiao-Li Li, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/316,407

(22) Filed: Dec. 12, 2008

(65) Prior Publication Data

US 2009/0156059 A1 Jun. 18, 2009

(30) Foreign Application Priority Data

Dec. 12, 2007 (CN) ..... 2007 2 0131418 U

(51) Int. Cl.
*H01R 9/03* (2006.01)

(52) U.S. Cl. ..... 439/607.41; 439/660

(58) Field of Classification Search ..... 439/101, 439/108, 449, 497, 578, 607.41–607.52
See application file for complete search history.

(56) References Cited

U.S. PATENT DOCUMENTS

| | | | | |
|---|---|---|---|---|
| 7,210,965 | B1 | 5/2007 | Zhong | |
| 7,494,384 | B2 * | 2/2009 | Friedhof | 439/701 |
| 7,534,143 | B1 * | 5/2009 | Tsao et al. | 439/607.41 |
| 7,559,802 | B2 * | 7/2009 | Hu et al. | 439/607.41 |

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

A cable assembly in accordance with the present invention comprises an electrical connector including an insulative housing defining a mating portion and a pair of positioning portions extending rearwardly from the mating portion, a plurality of terminals received in the insulative housing and at least one metal shell surrounded the insulative housing; a cable electrically terminated to the terminals; and a rear cover substantially enveloping the insulative housing and snugly supported by the positioning portions.

7 Claims, 7 Drawing Sheets

CABLE ASSEMBLY HAVING OUTER COVER ROBUSTLY SUPPORTED

FIELD OF THE INVENTION

The present invention relates to a cable assembly, and more particularly to a cable assembly with an outer cover robustly supported by portions of a housing of a connector thereof thereby preventing the outer cover from being swayed with respect to the housing.

DESCRIPTION OF THE PRIOR ART

U.S. Pat. No. 7,210,965 B1 issued to Zhong etc. (hereinafter referred to as Zhong '965 patent) on May 1, 2007 discloses a cable connector assembly 1, it includes an electrical connector 100, a cable 200, an inner cover 300 and an outer cover 400 covering the outer portion of the electrical connector 100 and the cable 200, the inner cover 300 is received in one end of the outer cover 400 and covers the electrical connector 100. Two lateral sides of the outer cover 400 are general semicircle shape and defines a plurality of bulges 420 in the laterals of the inner of the outer cover 400 for forming a plurality of notches 430. The connector 100 defines an upper shelter 15 and a lower shelter 16 therein, the upper shelter 15 and lower shelter 16 respectively has a pair of upper clasping slices 151 and a pair of lower clasping slices 152 which can be inserted into the notches 430 of the outer cover 400, thus, the outer cover 400 can be assembled to the electrical connector 100.

Please referring to FIGS. 6 and 7 of the Zhong '965 patent, the upper shelter 15 and lower shelter 16 are covered by the outer cover 400, however, there are a pair of gaps respectively formed between the outer cover 400, the upper shelter 15 and the lower shelter 16 so that the outer cover 400 are not tightly fitting around the upper shelter 15 and lower shelter 16 tightly, and the plug portion of the cable connector assembly 1 will be deflected relative to the outer cover 400 when the cable connector assembly 1 in the process of plugging into and pulling out from the complementary connector due to the upward or downward force exerted on the outer cover 400 of the cable connector assembly 1. In addition, in the process of manual assembling of the cable connector assembly 1, the positioning error between the outer cover 400, upper shelter 15 and lower shelter 16 are generated so that the central axes of the outer cover 400 and the housing 11 are misaligned, in other words, the parallelism therebetween are not well.

As discussed above, an improved cable assembly overcoming the shortages of existing technology is needed.

SUMMARY OF THE INVENTION

Accordingly, an object of the present invention is to provide a cable assembly with the insulative housing and the cover thereof positioned well and attached tightly making the central axis of the insulative is aligned with the central axis of the cover.

In order to achieve the above-mentioned objects, a cable assembly in accordance with the present invention comprises an electrical connector including an insulative housing defining a mating portion and a pair of positioning portions extending rearwardly from the mating portion, a plurality of terminals received in the insulative housing and at least one metal shell surrounded the insulative housing; a cable electrically terminated to the terminals; and a rear cover substantially enveloping the insulative housing and snugly supported by the positioning portions.

Other objects, features and advantages of the invention will be apparent from the following detailed description taken in connection with the accompanying drawings.

DESCRIPTION OF THE PREFERRED EMBODIMENTS

Figure 1:
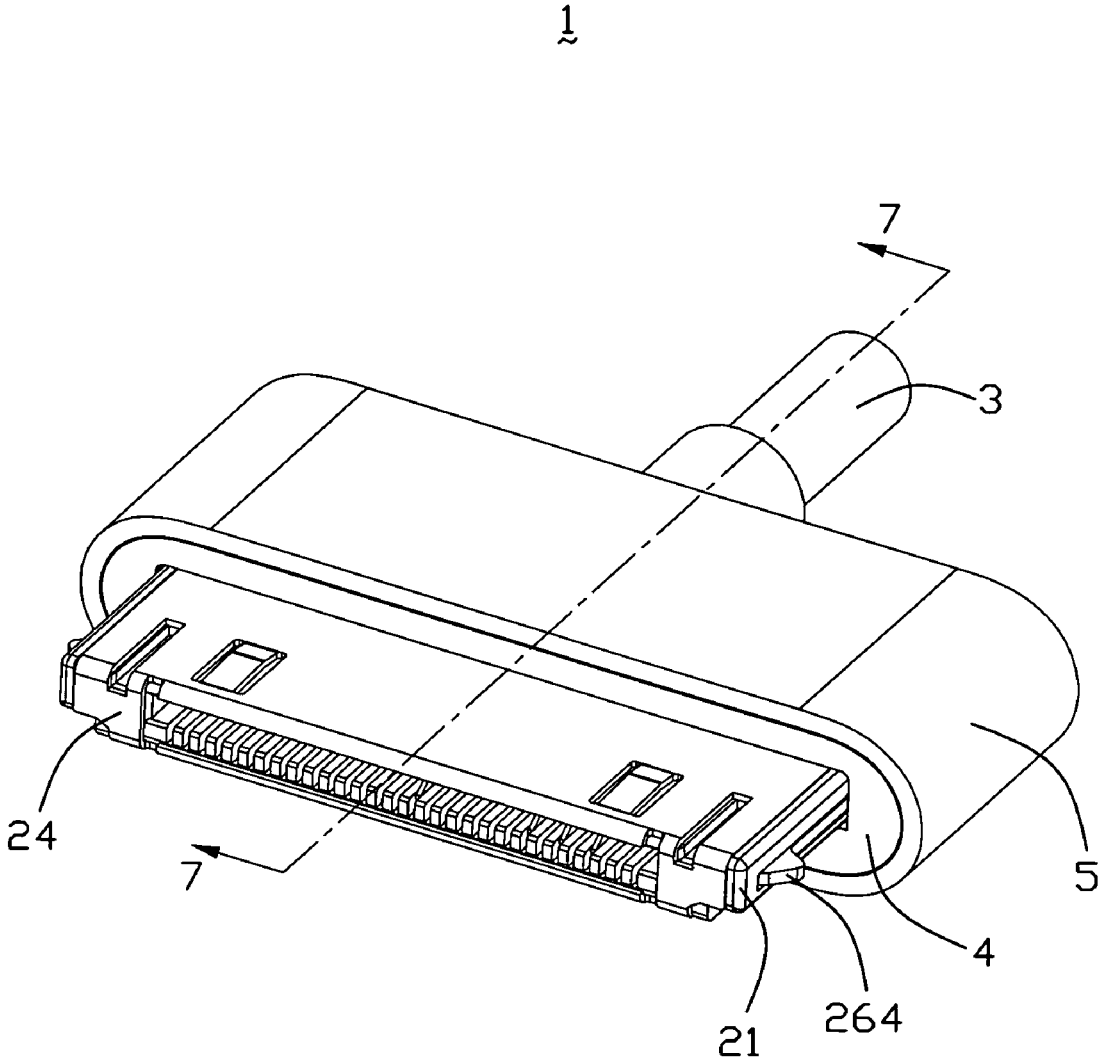
FIG. 1 is a perspective view of a cable assembly in accordance with the present invention.

Reference will now be made to the drawing figures to describe the present invention in detail.

Figure 2:
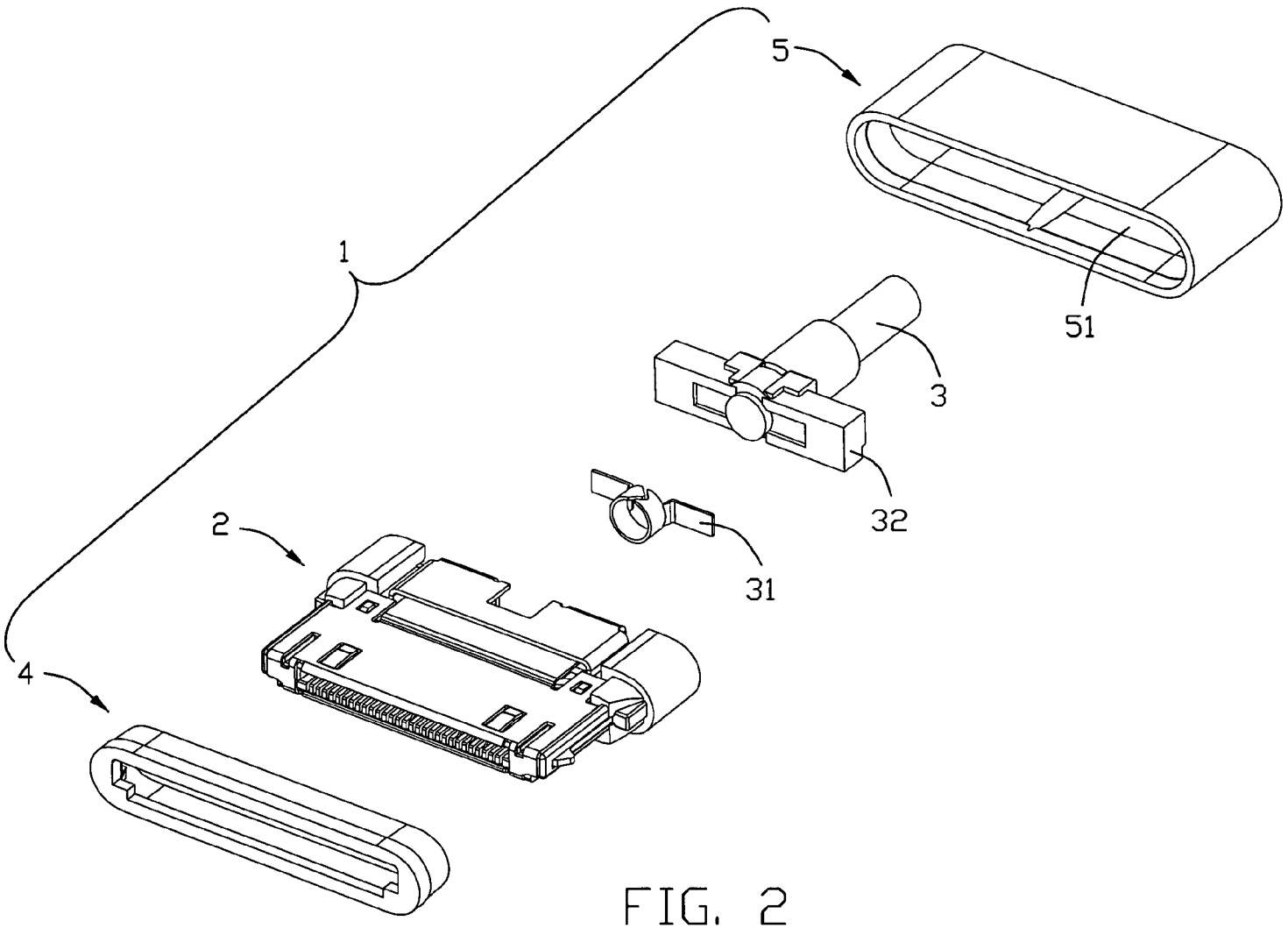
FIG. 2 is a partial exploded, perspective view of the cable assembly of FIG. 1.

Referring to FIGS. 1 to 2, a cable assembly 1 in accordance with the present invention includes an electrical connector 2, a cable 3 electrically connected to the electrical connector 2, a front cover 4 and a rear cover 5 assembled to the electrical connector 2.

Referring to FIGS. 2 to 5, the electrical connector 2 includes an insulative housing 21, a plurality of the terminals 22 received in the insulative housing 21, a printed circuit board 23 soldered to the terminals 22 and a front metal shell 24, an upper rear metal shell 25 and a lower rear metal shell 26 surrounding the insulative housing 21.

The insulative housing 21 includes a mating portion 211 and a pair of positioning portions 212 extending rearwardly from two sides of the mating portion 21. The mating portion 211 is generally of a flat rectangular shape defining a receiving space 2111 recessed from a front surface thereof. The receiving space 2111 is enclosed by a bottom wall, a top wall and two side walls of the mating portion 211. A plurality of terminal receiving passageways 2112 are defined in an inner surface of the bottom wall, extending in a longitudinal direction and arranged in a transverse direction. A plurality of openings 2113 are defined in a rear wall of the insulative housing 21 and communicated with the receiving space 2111. A pair of slots 2114 are formed on the two opposite sides of the insulative housing 21, and a pair of ribs 2115 are protruded from the front and top surface and disposed on the opposite edges of the insulative housing 21, and two notches 2116 are formed on the top surface of insulative housing 21 and disposed between the receiving space 2111 and rib 2115 in the transverse direction, and a pair of ribs 2117 are also formed on two lateral sides of the bottom surface of the insulative housing 21.

The pair of positioning portions 212 extends rearwardly from two sides of the mating portion 211 of the insulative housing 21 are symmetrically arranged at lateral sides thereof. The positioning portion 212 defines a base section 2121 extending rearwardly from rear surface of the mating portion 211. The base section 2121 defines a horizontal through slot 2122 communicated with the corresponding slot 2114 formed on the side of the insulative housing 21. A pair of projections 2123 are formed on the top surface of the base section 2121. A U-shaped rear positioning block 2124 protruding outwardly from the top and bottom surfaces of the base section 2121. The rear positioning block 2124 includes a pair of horizontal sections 2125 respectively protruding outward from the top and bottom surfaces of the base section 2121 and a curve section 2126 connected with the two horizontal section 2125. The outer surface of the curve section 2126 is substantially of semicircular-shaped and the inner surface of the curve section 2126 is a vertical plane. The inner surface of the curve section 2126 is parallel to an outer side surface of the base section 2121, and a passageway 2127 extending in a longitudinal direction is formed therebetween. The passageway 2127 is communicated with the slot 2114 formed on the two sides of the mating portion 211 and the horizontal through slot 2122. A path is formed along the horizontal through slot 2122, the passageway 2127 and the slot 2122. The base section 2121 further defines a front positioning block 2128 which is similar to the rear positioning block 2124 and located in the front of the rear position block 2124. A pair of ribs 2129 are protruded outward from inclined lateral sides of the front positioning block 2128 respectively.

Figure 3:
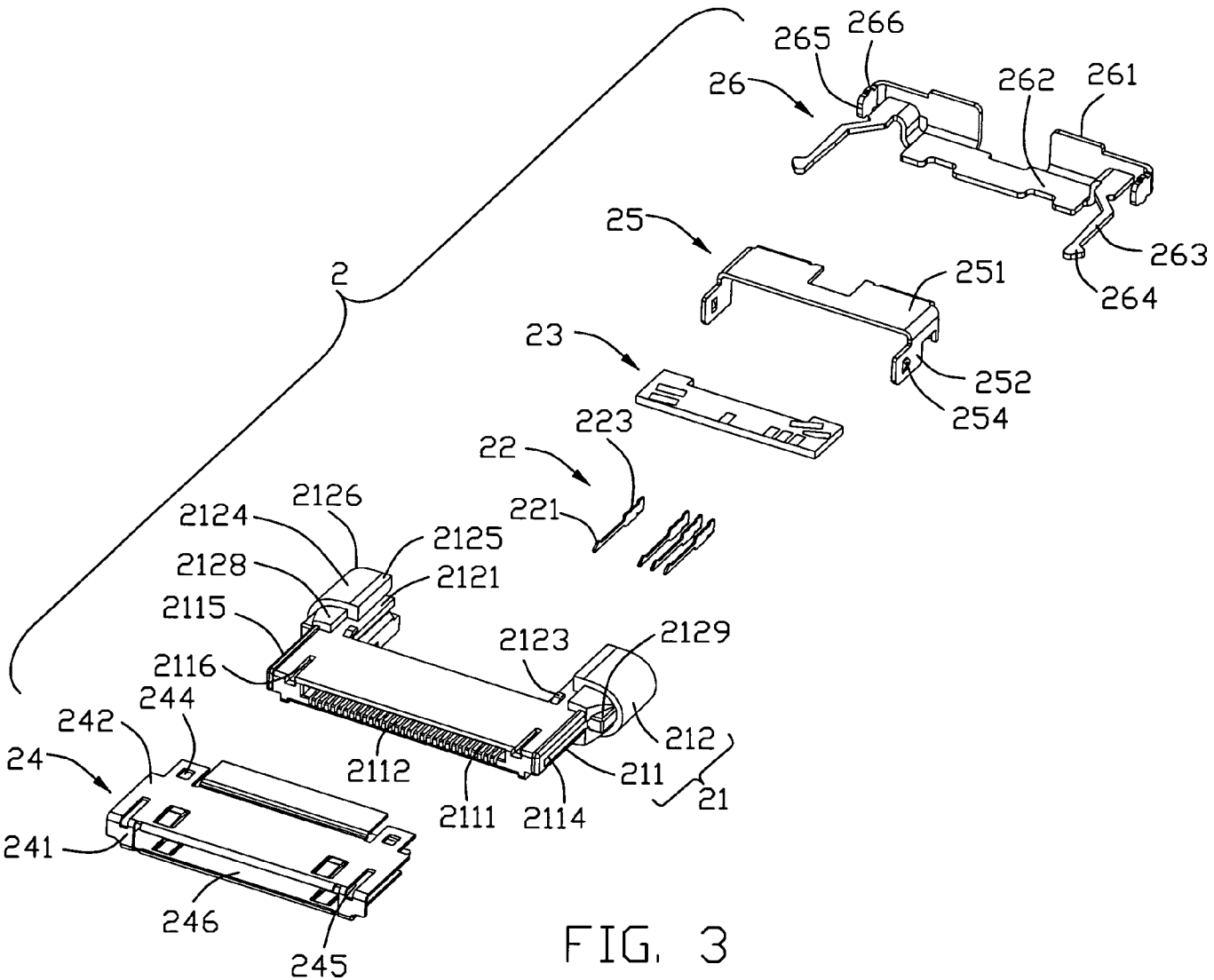
FIG. 3 is an exploded, perspective view of an electrical connector of the cable assembly.
Figure 4:
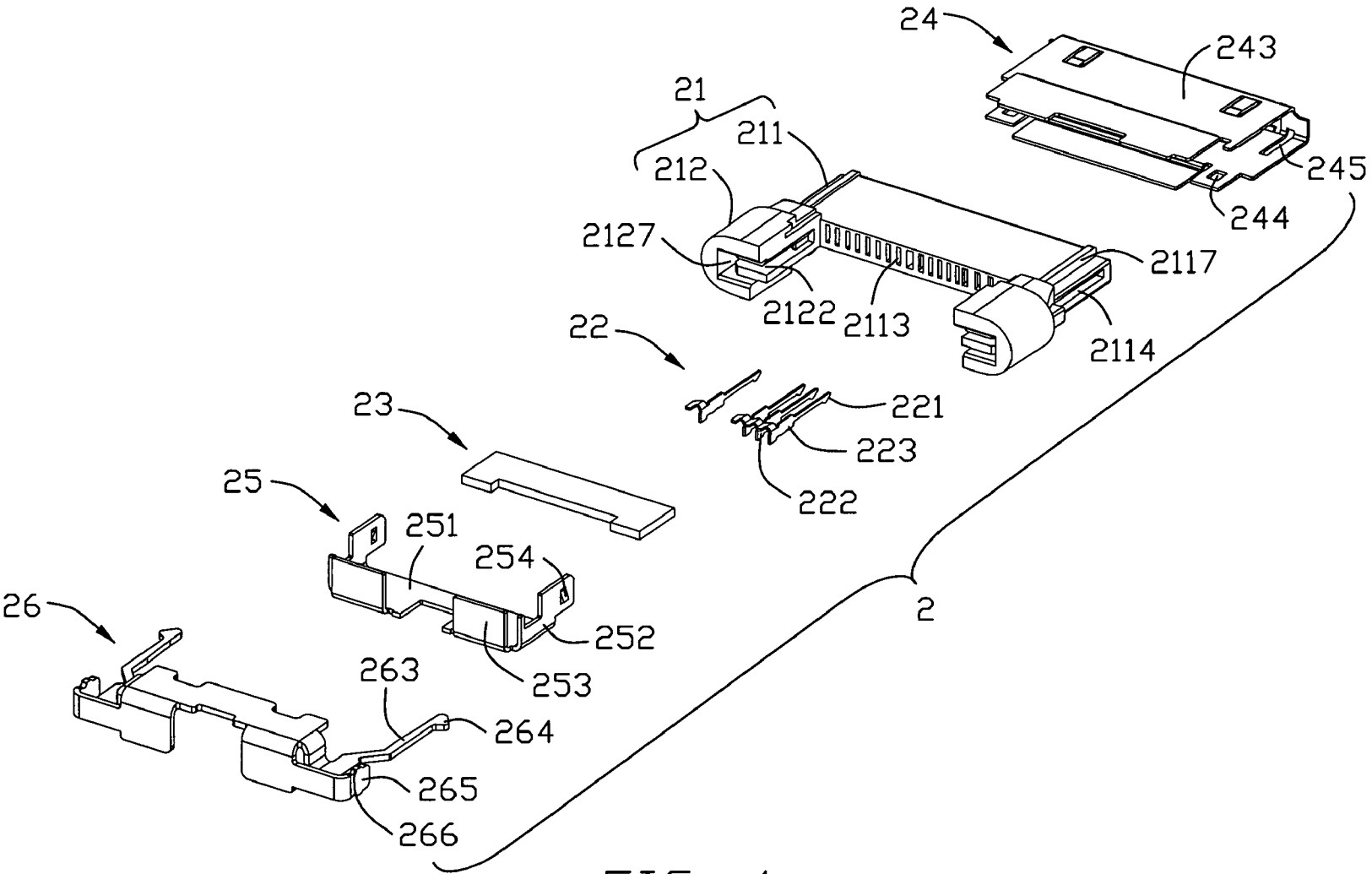
FIG. 4 is similar to FIG. 3, but viewed from another aspect.
Figure 5:
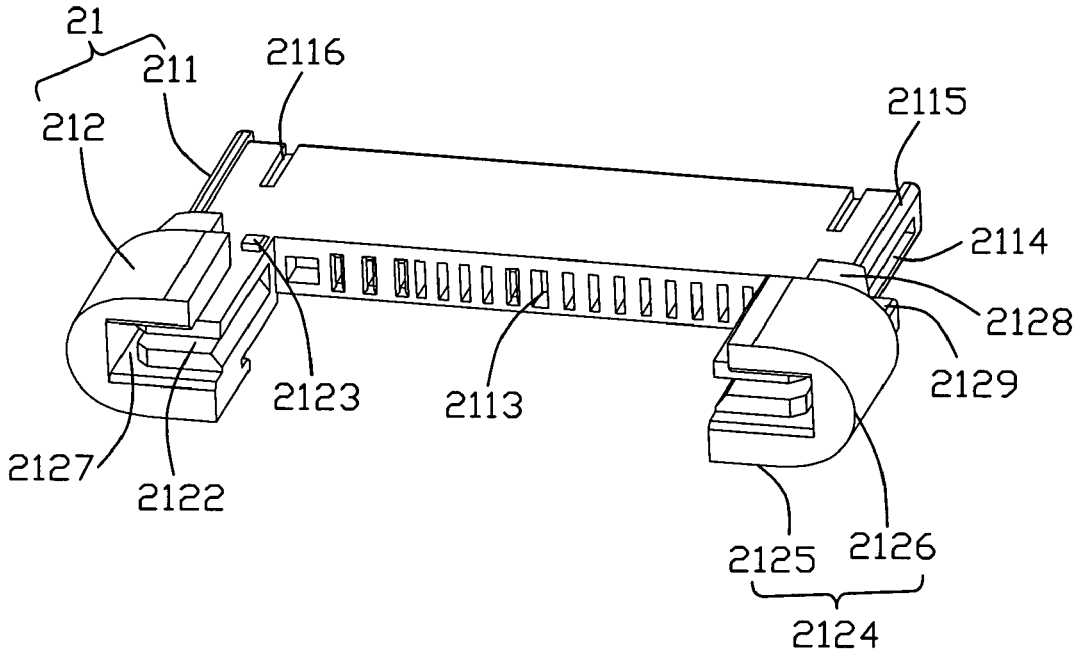
FIG. 5 is a perspective view of a housing of the cable assembly.
Figure 6:
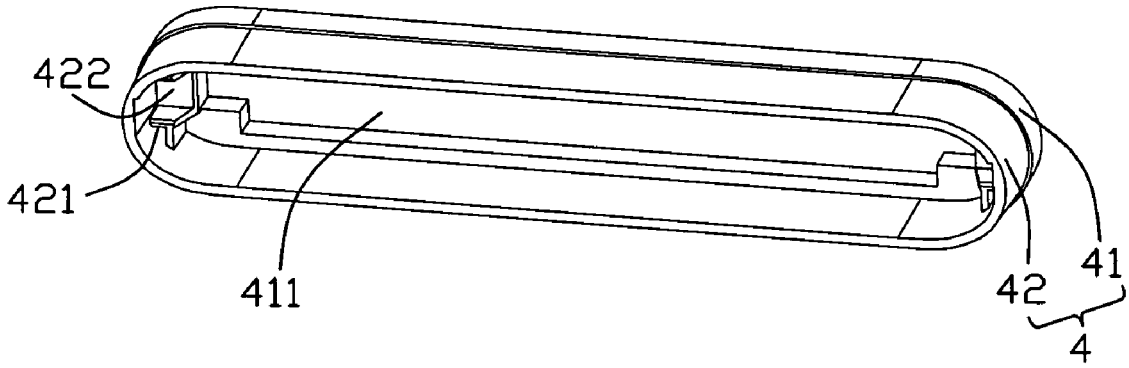
FIG. 6 is a is a perspective view of a front cover of the cable assembly.
Figure 7:
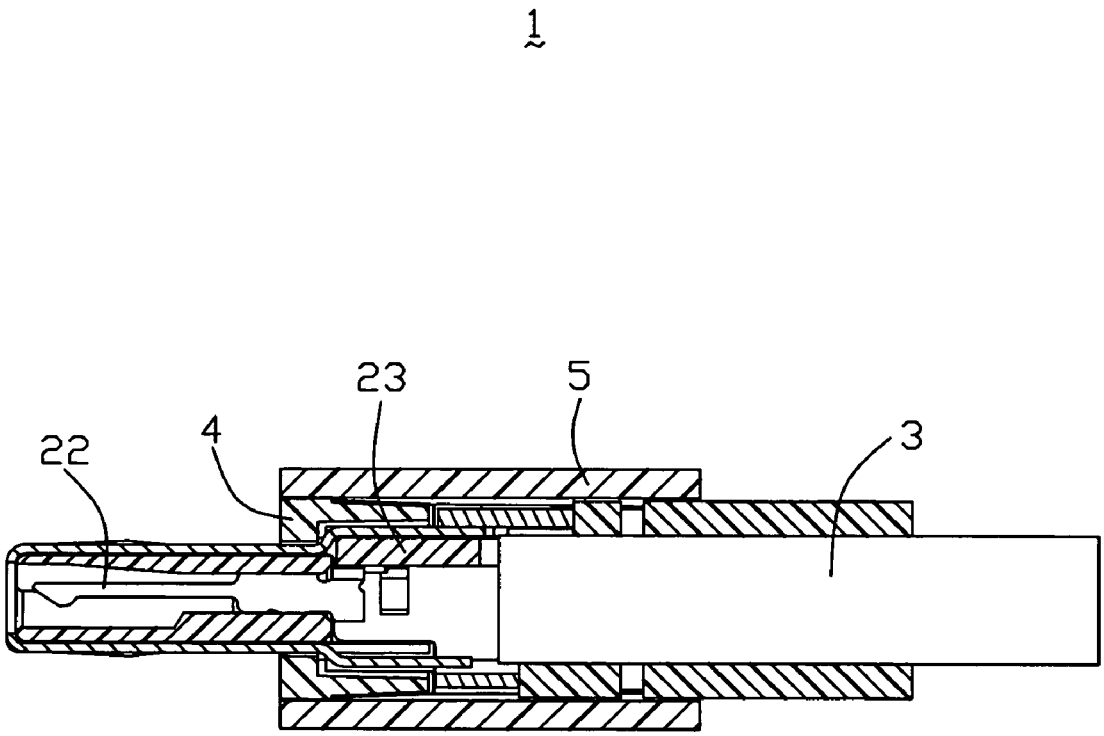
FIG. 7 is a cross section view of the cable assembly of FIG. 1 taken along line 7-7.

Referring to FIGS. 3 to 4 and 7, the terminals 22 are received in the insulative housing 2 and each terminal 22 defines a contacting section 221, a soldering section 222 and an engaging section 223 connected with the contacting section 221 and the soldering section 222.

The printed circuit board 23 can be soldered to the soldering sections 222 of the terminals 22.

The front metal shell 24 can be stamped from a metal plate, it includes a front wall 241, a top wall 242 and a bottom wall 243 extending rearwardly from upper and lower sides of the front wall 241. The top wall 242 defines a pair of holes 244 at the rear end thereof engaged with the projections 2123 formed on the base section 2121 of the positioning portion 212, and further defines a pair of slits 245 at two sides thereof corresponding to the notches 2116 formed on the top surface of the mating portion 211. The front wall 241 defines an opening 246 corresponding to the receiving space 2111 of the mating portion 211.

The upper rear metal shell 25 includes a top wall 251, a pair of side walls 252 and a rear wall 253 extending downwardly respectively from two sides and rear end of the top wall 251. The top wall 251 and two side walls 252 each defines a cutout. The two side walls 252 each defines a protrusion 254 thereon.

The lower rear metal shell 26 includes a rear wall 261, a bottom wall 262 extending forwardly from lower end of rear wall 261, a pair of latch arms 263 extending upwardly and forwardly from two sides of the bottom wall 261 in turn. The pair of latch arms 263 each has a locking barb 264 extending outward from the free end thereof. A pair of engaging arms 265 extending forwardly from two sides of the rear wall 261, and each engaging arm 265 has a plurality of barbs 266 on its upper and lower surfaces.

The upper and lower rear metal shell 25, 26 enclose the rear portion of the insulative housing 21. A hollow termination nest (not figured) are enclosed by the between the two positioning portions 212 and the upper and lower rear metal shell 25, 26.

Referring to FIGS. 2 and 7, a metal ring 31 is crimped to the cable 3. A strain relief block 32 is formed on the front end of the cable 3 and disposed out of the metal ring 31.

Referring to FIGS. 1, 2 and 7, the rear cover 5 is generally pedrail-shaped defining a rear side and a peripheral side. A receiving room 51 is enclosed by the rear side and the peripheral side, and a hole (not figed) is defined in the rear side.

Referring to FIGS. 1, 2, 6 and 7, the shape of the front cover 4 is similar to that of the rear cover 5, but the size of the front cover 4 is smaller than the rear cover 5. The front cover 4 includes a guiding portion 41 and a positioning portion 42 extending rearwardly from the guiding portion 41. The guiding portion 41 has a slot 411 corresponding to the interface of the electrical connector 2 and allowing the front end of the electrical connector 2 to pass through. The outer diameter of the positioning portion 42 is smaller than the guiding portion 41. A pair of paralleled ribs 421 are respectively formed on the two inner sides of the positioning portion 42. A receiving slot 422 is formed between the paralleled ribs 421. The outer surface of the front cover 4 can be attached to the inner surface of the rear cover 5.

Referring to FIGS. 1 to 7, the assembling process of the cable assembly 1 in according to the present invention starts from assembling the terminals 22 into the insulative housing 21 in a rear to front direction. The terminals 22 are passed through the openings 2113 and the terminal receiving passageways 2112 in turn. The contacting section 221 of the terminal 22 is received into the terminal receiving passageways 2112, the engaging section 223 engages with the openings 2113 making the terminal 22 positioned in the insulative housing 2 and the soldering section 222 extends out of the rear end of the mating portion 211 of the insulative housing 21.

After the terminals 22 are assembled to the insulative housing 21, then soldering the printed circuit board 3 to soldering section 222 of the terminals 22 when the printed circuit board 23 is supported by the supporting apparatus (not figured) or other accessorial device. And then soldering the cable 3 assembled with the metal ring 31 to the printed circuit board 23.

After the printed circuit board 23 and the cable 3 are together assembled to the insulative housing 21 with the terminals 22 therein, then assembling the lower rear metal shell 26 to the insulative housing 21, the latch arm 263 of the rear metal shell 26 is received into the space comprised by the horizontal through slot 2122, the passageway 2127 and the slot 2114, the locking barb 264 is exposed out of the slot 2114, the engaging arms 265 is received and engaged with the passageway 2127 by the barbs 266 thereon interfering with the inner surface of the passageway 2127.

After the lower rear metal shell 26 assembled to the insulative housing 21, then assembling the upper rear metal shell 25 to the insulative housing 21. The protrusion 254 disposed on the side wall 252 is received into the horizontal through slot 2122 making the lower rear metal shell 26 positioned on the insulative housing 21. So the printed circuit board 23 is enclosed by the upper and lower metal shell 25, 26.

Then, assembling the front metal shell 24 to the insulative housing 21 in a front to rear direction. The front wall 241 and the front section of the top wall 242 disposed between the pair of ribs 2115 are fitting to the front and top surface of the mating portion 211 of the insulative housing 21. The front section of the bottom wall 243 disposed between the pair of ribs 2117 is fitting to the bottom surface of the mating portion 211. The pair of holes 244 at the rear end of the top wall 242 engages with the projections 2123 formed on insulative housing 21.

After the front metal shell 24, the upper rear metal shell 25 and the lower rear metal mell 26 are all assembled to the insulative housing 21, the printed circuit board 23 are surrounded by the above metal shells 24, 25, 26. Then the strain relief block 32 is formed in the room surrounded by the metal shells 24, 25, 26 through the insert molding method.

Then, assembling the rear cover 5 to the electrical connector 2 in a rear to front direction, the cable 3 passes through the hole of the rear wall of the rear cover 5. The pair of rear positioning blocks 2124 of the positioning portions 212 of the insulative housing 21 are received into the receiving room 51, the outer surface of the positioning block 2124 is attached to the inner surface of the rear cover 5. The rear cover 5 and the positioning block 2124 are stuck with each other by the gluewater so that the insulative housing 21 and the rear cover 5 are positioned tightly and at a lower angle therebetween in the horizontal and vertical direction.

At last, assembling the front cover 4 into the receiving room 51 of the rear cover 5 and out of the insulative housing 21. The pair of ribs 2129 of the front positioning block 2124 are received into the receiving slot 422 of the front cover 4. The front cover 4 can be stuck to the front positioning block 2128 and the rear cover 5 by the gluewater. The front cover 4, the rear cover 5 and the insulative housing 21 are assembled together tightly and positioned in high precision.

After the above assembling steps, the entire process of assembling the cable assembly 1 is finished.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What we claimed is:

1. A cable assembly, comprising: an electrical connector comprising an insulative housing defining a mating portion and a pair of positioning portions extending rearwardly from the mating portion, a plurality of terminals received in the insulative housing and at least one metal shell surrounded the insulative housing; a cable electrically terminated to the terminals; and a rear cover substantially enveloping the insulative housing and snugly supported by the positioning portions, wherein each positioning portion defines a base section and a rear positioning block extending outwardly from the base section received into a receiving room of the rear cover, wherein the positioning portion further defines a front positioning block extending outwardly from the base section and near to the rear positioning block, wherein the positioning portion defines a horizontal through slot in the base section and a passageway extending in a longitudinal direction communicated with the horizontal through slot and disposed between the base section and the rear positioning block, wherein the rear positioning block includes a pair of horizontal section respectively protruding from the top and bottom surface of the base section and a curve section connected with the two horizontal section and spaced from the base section in a widthwise direction, wherein a pair of slots are respectively defined in the two sides of the mating portion communicated with the horizontal through slot and the passageway, wherein the metal shell has a front metal shell, an upper rear metal shell and a lower rear metal shell assembled to the insulative housing, wherein the lower rear metal shell defines a pair of latch arms respectively received in the horizontal through slot, the passageway and the pair of slots communicated with each other, and each of the latch arms has a locking barb extending out of the slot, wherein the cable assembly further comprises, a printed circuit board electrically connecting with the terminals and the cable, wherein the cable assembly further comprises a front cover covering the front positioning block and received into the receiving room of the rear cover, wherein the front cover defines a pair of receiving slots therein, and the front positioning block defines a pair of ribs received into the receiving slots.

2. The cable assembly as recited in claim 1, wherein the mating portion defines a receiving space recessed from a front surface thereof, and a plurality of terminal receiving passageways are formed in one inner side of the receiving space.

3. The cable assembly as recited in claim 2, wherein a plurality of openings are formed on the rear surface of the insulative housing and communicated with the receiving space.

4. The cable assembly as recited in claim 1, wherein each of the terminals defines a contacting section extending into the mating portion, a soldering section extending out of the back surface of the housing and disposed between the pair of the positioning portions and an engaging portion connected with the contacting section and the soldering section.

5. The cable assembly as recited in claim 1, wherein the cable assembly further comprises a metal ring crimped the cable and a strain relief block formed on the front end of the cable and disposed out of the metal ring.

6. The cable assembly as recited in claim 1, wherein an outer surface of the rear positioning block of the positioning portion is arc shape.

7. An electrical connector comprising:

an insulative housing defining a main body with a plurality of terminals therein, said main body defining a pair of slots in two lateral sides thereof, and a pair of positioning portion extending rearwardly from two opposite lateral sides of a rear surface of the main body and cooperating with the main body to define behind the rear surface a receiving space into which tails of the terminals extend;

a metallic front shell enclosing said main body and extending beyond the rear surface; and an insulative front cover assembled to the housing and cooperating with the housing to sandwich a rear portion of the front shell therebetween;

a printed circuit board horizontally assembled into the receiving space from a rear ends of the pair of positioning portion and shielded by said shell;

a metallic rear shell assembled to the housing behind the front shell, and including unitarily a bottom wall, a rear wall and a pair of latch arms extending forwardly, outwardly and sidewardly through the corresponding pair of slots of the main body of the housing; and an insulative rear cover enclosing said front cover and said rear shell.

* * * * *